United States Patent [19]

Combe

[11] Patent Number: 4,977,959

[45] Date of Patent: Dec. 18, 1990

[54] METHOD OF POSITIONING OF PLUGS OR SCREENS BY HORIZONTAL DRILLING

[75] Inventor: Jean Combe, Bougival, France

[73] Assignee: Institut Francais du Petrole, Rueil Malmaison, France

[21] Appl. No.: 870,808

[22] Filed: Jun. 5, 1986

Related U.S. Application Data

[63] Continuation of Ser. No. 672,189, Nov. 16, 1984, abandoned.

[30] Foreign Application Priority Data

Nov. 18, 1983 [FR] France ..... 83 18354

[51] Int. Cl.[5] ..... E21B 43/16

[52] U.S. Cl. ..... 166/274; 166/50; 166/268

[58] Field of Search ..... 166/292, 268, 175, 50, 166/259, 285, 295, 294, 52, 274

[56] References Cited

U.S. PATENT DOCUMENTS

| | | | |
|---|---|---|---|
| 2,885,003 | 5/1959 | Lindauer | 166/268 |
| 3,692,110 | 9/1972 | Grady | 166/259 X |
| 4,022,279 | 5/1977 | Driver | 166/52 X |
| 4,385,662 | 5/1983 | Mullins et al. | 166/50 X |
| 4,393,936 | 7/1983 | Josendal | 166/268 X |

*Primary Examiner*—George A. Suchfield
*Assistant Examiner*—David J. Bagnell
*Attorney, Agent, or Firm*—Antonelli, Terry, Stout & Kraus

[57] ABSTRACT

A method for positioning at least one plug, or screen, between two fluids in a geological formation, a product intended to form said plug being injected through at least one substantially horizontal plane situated in the vicinity of the interface formed by said two fluids.

11 Claims, 2 Drawing Sheets

METHOD OF POSITIONING OF PLUGS OR SCREENS BY HORIZONTAL DRILLING

This is a continuation of application Ser. No. 672,189, filed Nov. 16, 1984, now abandoned.

BACKGROUND OF THE INVENTION

1. Field of the Invention

The present invention relates to the positioning of plugs or screens by using horizontal drilling.

The present invention may be more particularly used in the field of working mineral deposits. Thus, in thick deposits or with a fairly steep slope where the gas, oil and water tend to separate by increasing density from top to bottom during working, under the effect of gravity, the methods of recovering oil by injection of gaseous miscible fluids, or possibly surface-active products in liquid solution, generally have a good volumetric efficiency allowing a good recovery of the oil. The products thus injected in small quantities into vertical or sloping wells are however distributed unevenly in the deposit because of the high flow speeds near the well and because of the frequent local natural barriers between the wells. The result is a waste of products and a loss of efficiency.

2. Description of the prior art

The prior art may be illustrated by the British patent Nos. GB-A-2 096 670 and GB-A-1 458 799 and by the U.S. Pat. No. 4,289,354.

According to the first document cited, fluids are injected into the deposit through vertical wells. This method requires the drilling of numerous wells and does not provide uniform distribution of the fluid. In addition, this prior method is more restricted in application than the method of the present invention which is in nowise limited to sloping reservoirs.

SUMMARY OF THE INVENTION

The present invention allows these fluids to be much more uniformly distributed in the vicinity of the gas/oil or oil/water separation surfaces because these fluids are injected through horizontal wells or drains, at a lower speed and over longer distances.

In the following description, the term drain is essentially used for designating an artificial well member for producing or injecting a fluid. This well may possibly comprise at least one perforated tube over a portion of its length.

More precisely, the present invention provides a method for positioning at least one plug or screen between two fluids. According to this method, a product for forming said plug is injected through at least one substantially horizontal drain disposed in the vicinity of the interface formed by said two fluids. When one of the fluids is gaseous and the other liquid, the product to be injected may be a gas miscible with the liquid, the density of this miscible gas being greater than that of the gaseous fluid contained in the formation. This miscible gas may be $CO_2$ or a hydrocarbon gas.

When the fluids contained in the formation are liquids having different densities, the fluid injected may have a density between those of the two fluids, including limit values. The product injected may be a solution of surface-active products.

When the separation surface has an oblong shape, the horizontal drain or drains may be disposed substantially along the main axis of this separation surface.

When several drains are used for injecting the product intended to form the plug, or screen, at least some of said drains may be disposed about the periphery of the separation surface, at a distance from the frontier line of said surface.

The horizontal drain or drains will be preferably situated in the fluid to be produced over at least a portion of their length.

When fluid volumes equivalent to the amounts produced are to be injected into the mineral deposit, the drain used for injecting the plug product may also serve for injecting the driving fluid in the necessary amounts. Moreover, the driving fluid may, in some cases, be identical to the product serving for forming the plug.

BRIEF DESCRIPTION OF THE DRAWINGS

The present invention will be better understood and its advantages will appear more clearly from the description of the following examples, illustrated by the accompanying Figures in which.

DESCRIPTION OF THE PREFERRED EMBODIMENTS

Figure 1:
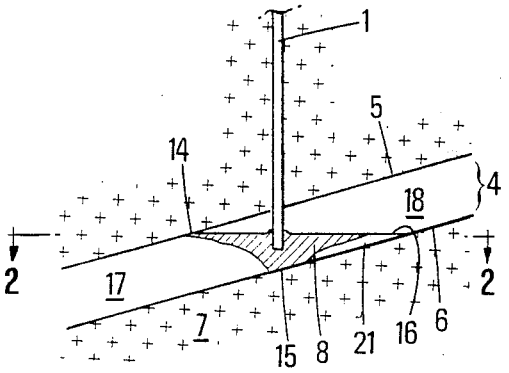
FIG.1 (PRIOR ART)
FIGS. 1 and 2 illustrate the positioning of the plug according to the prior art.
Figure 2:
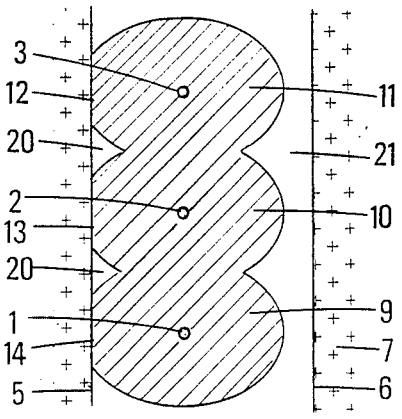
FIG.2 (PRIOR ART)

FIGS. 1 and 2 show the positioning of a plug between two fluids according to the prior technique which uses several vertical wells, with FIG. 2 being taken along line 2—2 of FIG. 1.

These vertical wells 1, 2 and 3 are drilled so as to penetrate into layer 4 limited by the walls 5 and 6 of the geological formations 7.

The product 8 intended to form the plug is injected from vertical wells 1, 2 and 3 substantially in the vicinity of the interface 16 formed by the two fluids 17 and 18 between which it is desired to form the plug and spreads in the form of overlapping disks 9, 10 and 11 as is shown in FIG. 2 which is a top view of FIG. 1.

The product 8 thus injected is distributed unevenly in the deposit because of the high flow speeds of product 8 near the well and because of the frequent local natural barriers between the wells, as is shown in FIGS. 1 and 2.

In fact, in these Figures the injected product 8 has reached the top wall 5 of the reservoir at the positions located by references 12, 13 and 14, and the bottom wall 6 at the position designated by reference 15 (FIG. 1). Considering the symmetry of revolution, approximately it is true, of the distribution of the product 8, it can be readily understood that there is a waste of this latter and a loss of efficiency of such a plug.

Figure 3:
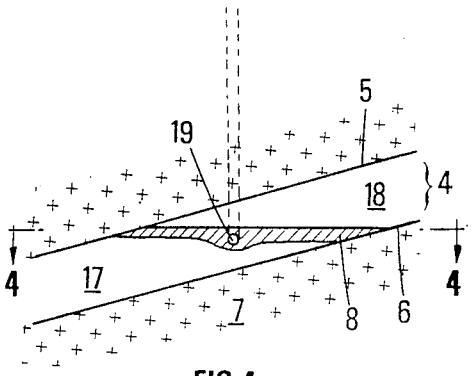
FIGS. 3 and 4 show one example of positioning a plug using a horizontal drain.
Figure 4:
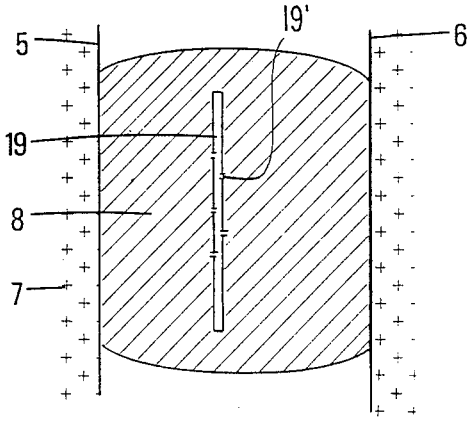

FIGS. 3 and 4 illustrate the placing of a plug according to the invention, by means of at least one substantially horizontal drain 19, having perforations 19' over a portion of its length.

Because of the great length of the horizontal drain the injection speeds of product 8 forming the plug are low; this promotes uniform distribution of product 8 (see FIGS. 3 and 4).

FIG. 4 is a sectional view along line 4—4 of FIG. 3. Zones unoccupied by product 8, such as those designated by references 20 and 21 in FIGS. 1 and 2, practically no longer exist after the positioning of plugs, or screens, in accordance with the invention (see FIGS. 3 and 4).

The thickness of the layer of product 8 forming the plug is much more even and thus may be reduced, if need be, so as to reduce the amounts of product 8 injected.

Figure 5:
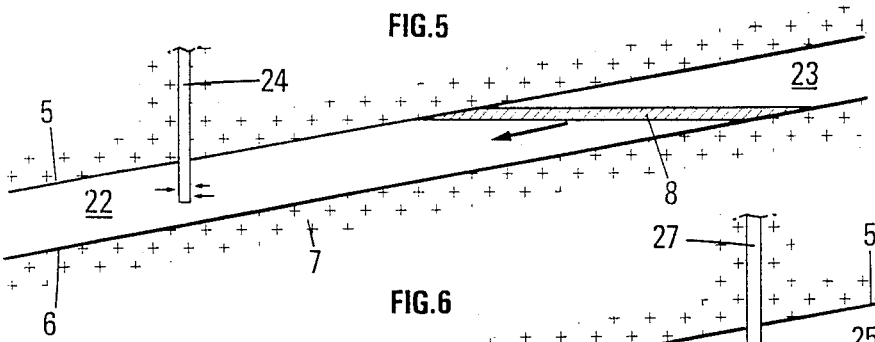
FIG. 5 shows one example of production of a deposit using the gas plug.
Figure 6:
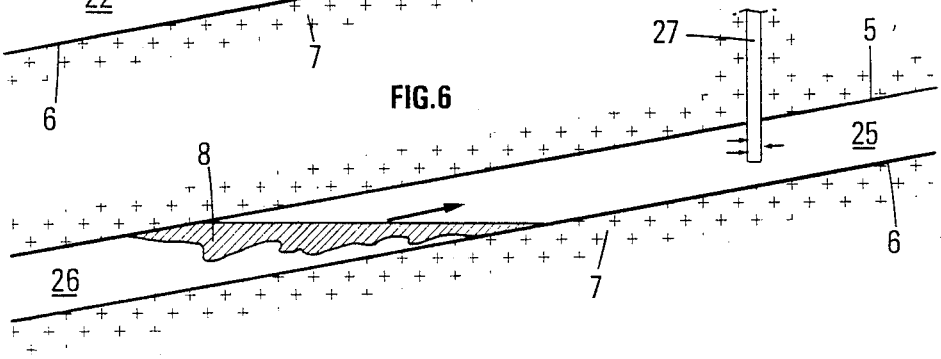
FIG. 6 illustrates one example of production of a deposit using a plug formed by a solution of surface-active products.

FIGS. 5 and 6 show the working of a mineral deposit after positioning of the plug.

FIG. 5 shows the case where the fluid 22 to be produced is denser than fluid 23. For instance, fluid 22 may be an oil and fluid 23 a gas. In this case, the fluid 8 injected for forming the plug 23 may be a gas miscible with oil (hydrocarbon gas or $CO_2$).

The miscible gas plug 23 is pushed by the pressurized gas on top of it (generally called gas-cap) and leaves very little residual oil 22 behind it.

The separation of the fluids depending on their density under the effect of gravity contributes to maintaining the miscible gas plug 23 between the oil 22 and gas 23.

In the case of FIG. 5, the oil is produced by a vertical well 24. But producing the oil by means of an inclined or horizontal drain still comes within the scope of the present invention.

FIG. 6 shows the case where the fluid 25 to be produced is denser than the second fluid present 26.

For example, fluid 25 may be an oil, fluid 26 an aquiferous fluid and the fluid injected 8 a surface-active solution.

The surface-active solution plug is pushed by the aquiferous fluid and leaves very little residual oil 25 behind it.

The separation of fluids 25 and 26 depending on their density, under the effect of gravity, contributes to maintaining the plug of surface-active solution below the oil column. The position of the plug at the top of the water zone is not, on the other hand, stabilized by gravity because of its density which is practically equal to that of water.

Of course, this is in no wise limitative and the product 8 injected for forming the plug may have an intermediate density between that of the two fluids 25 and 26 present in the formation . In the same way as in the example illustrated in FIG. 5, the oil is produced by a vertical well 27 but producing it by means of an inclined or substantially horizontal well comes within the scope of the present invention.

The layout of the drilled wells may be reduced, depending on the geometry of the mineral deposit and on the separation surfaces of the fluid, to the two extreme situations hereafter:

the case of a monoclinal in which the fluid to be produced 28 as well as at least one other fluid 29 or 30 is comprised between parallel walls 31 and 32 forming the reservoir.

Figure 7:
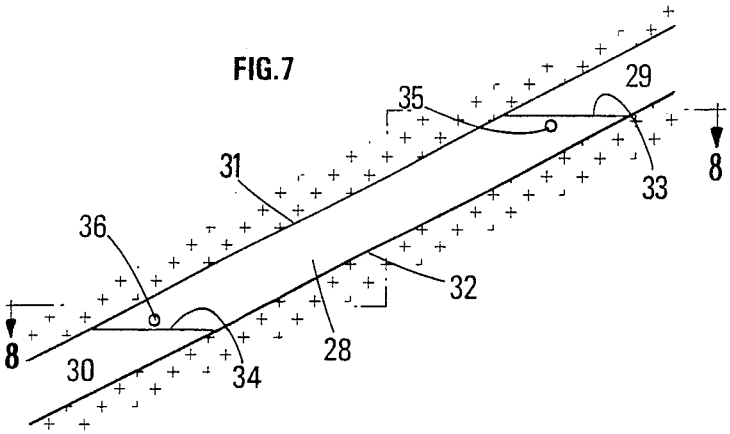
FIGS. 7 and 8 show one example of positioning a plug in the case of a deposit having a monoclinal structure.
Figure 8:
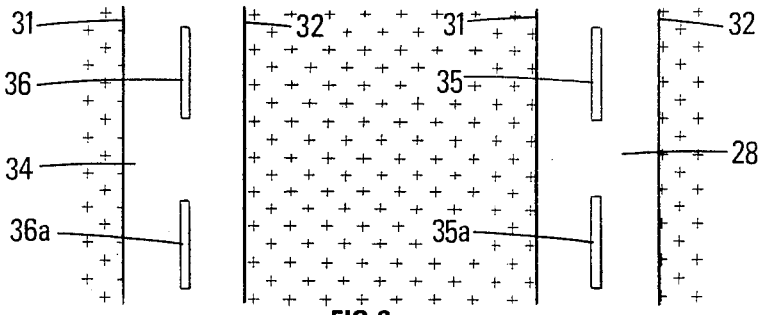

FIGS. 7 and 8 illustrate the case of a monoclinal comprising a fluid to be produced 28 of intermediate density, such as oil, included between two fluids 29 and 30, such respectively as a gas and a primary or secondary aquiferous fluid.

FIG. 8 is a sectional view along line 8—8 of FIG. 7.

These FIGS. 7 and 8 illustrate the particular case, but in no wise limitatively, of positioning two plugs or screens situated at the two interfaces 33 and 34 respectively between oil 28 and gas 29 and between oil 28 and the aquiferous fluid 30. The products, for forming a plug at each of the interfaces 33 and 34, are injected through at least one horizontal drain 35, respectively 36. Of course, the products may be injected through several horizontal drains 35, 35*a* respectively 36, 36*a* . . .

the case of a complete anticlinal, in which the fluid to be produced is included in a dome shaped reservoir 36.

Figure 9:
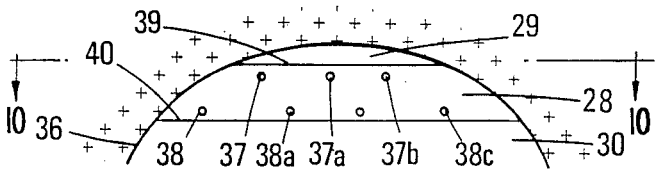
FIGS. 9 and 10 show one example of an arrangement of horizontal drains for positioning a plug in the case of a complete anticlinal.
Figure 10:
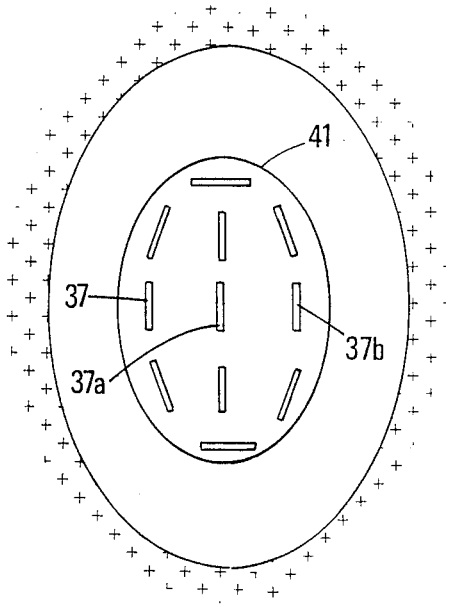

FIGS. 9 and 10 show the case of a complete anticlinal comprising a fluid to be produced 28 of intermediate density, such as oil, between two fluids 29 and 30, such respectively as a gas and an aquiferous fluid.

FIG. 10 is a sectional view along line 10—10 of FIG. 9.

These two Figures illustrate a particular but non limitative case of positioning two plugs or screens situated at the two interfaces 39 and 40 respectively between the oil 28 and gas 29 and between oil 28 and the aquiferous fluid 30. The products for forming a plug at each of the interfaces 39 and 40 are injected through at least one horizontal drain 37*a* and 38*a* respectively. The products used for forming the plugs may be injected from several horizontal drains 37, 37*a*, 37*b* respectively 38, 38*a*, 38*b*, 38*c* . . . , disposed so as to ensure good distribution of the product serving for forming the plug (S) or screen (S).

In the case of FIG. 10, since the reservoir is oblong, horizontal drains have been placed substantially along the main axis of the separation interface and others at the periphery at a distance from line 41 formed by the intersection of the separation interface with the walls of the reservoir. This arrangement may be adopted for each of the two interfaces.

The horizontal drains for injecting products are situated in the vicinity of the separation interface defined by the fluid to be produced and by the other fluids present in the formation, preferably on the same side as the fluid to be produced.

Some of these drains may be situated in the fluid to be produced 28 over a part at least of their length.

It is still within the scope of the invention to inject a sufficient amount of the product intended to form the plug for pushing the fluid or fluids to be produced.

What is claimed is:

1. A method for positioning at least one plug or screen at a longitudinal interface between two different fluids in a geological formation, said interface having an oblong shape, which comprises injecting a fluid product intended to form said plug or screen which extends into the formation through injection means including at least one substantially horizontal drain member, said injection being effected through said at least one substantially horizontal drain member disposed in the vicinity of the interface formed by said two different fluids; and in order to provide a separation surface having an oblong shape, said at least one substantially horizontal drain member being disposed substantially along the main axis of said separation surface; said at least one substantially horizontal drain member having perforations along its length for distributing the fluid product evenly and slowly into the fluid to be produced and forming said at least one plug or screen along said interface whereby the two different fluids are essentially separated from each other.

2. Method according to claim 1, applied to the case where one of the fluids is gaseous and the other liquid, wherein the injected product is a gas miscible with the liquid and whose density is greater than that of the gaseous fluid contained in the formation.

3. Method according to claim 2, wherein said injected product is carbonic gas.

4. Method according to claim 2, wherein the injected product is a hydrocarbon gas.

5. Method according to claim 1, wherein in the case where said fluids have different densities, said injected fluid product has a density between those of the two different fluids, inclusive of limit values.

6. Method according to claim 5, wherein said injected product is a surface-active solution.

7. Method according to claim 1, wherein in the case where several drain members are used for injecting the product intended to form the plug or screen, horizontal drain members are disposed about the periphery of said separation surface, at a distance from the frontier line of said surface.

8. A method for positioning at least one plug or screen at a horizontal interface between two different fluids in a geological formation, which comprises injecting a fluid product to form said plug or screen into the formation through injection means including at least one substantially horizontal drain member, said injection being effected through said at least one substantially horizontal drain member disposed in the vicinity of the interface formed by said two different fluids; said at least one drain member having perforations along its length for distributing the fluid product evenly and slowly into the fluid to be produced and forming said at least one plug or screen along said interface whereby the two different fluids are essentially separated from each other; and producing at least one of said two different fluids using the injection of a pushing or driving fluid, said pushing fluid being injected through the drain member which served for injecting a product for forming said plug or screen.

9. Method according to claim 8, wherein the pushing fluid is identical to the fluid used for forming the plug.

10. Method according to claim 8, wherein said horizontal drain member is situated in the fluid to be produced over at least a portion of its length.

11. A method for positioning at least one plug or screen at an interface between oil and gas in a geological formation to promote recovery of the oil, said oil being surmounted by the gas at the interface and said interface having an oblong shape which has a major axis, which comprises injecting a hydrocarbon gas or $CO_2$ into the formation to form at least one plug or screen substantially at the interface between said gas surmounting said oil and the oil itself, said injection of hydrocarbon gas or $CO_2$ being effected via injection means including at least one substantially horizontal drain member disposed along said major axis and said injection being effected through said at least one substantially horizontal drain member disposed in the vicinity of said interface, said at least one substantially horizontal drain member having perforations along its length for distributing the hydrocarbon or $CO_2$ evenly and slowly into the oil to be produced, thereby forming at least one plug or screen that effectively separates the oil and gas from each other across the entire interface and promotes production of the oil, and producing the oil via another drain means extending from the formation of the surface.

* * * * *